US008201703B2

(12) United States Patent
Spence et al.

(10) Patent No.: US 8,201,703 B2
(45) Date of Patent: Jun. 19, 2012

(54) ARTICLE STACKING APPARATUS

(75) Inventors: Daniel J. Spence, Ottawa (CA); Bruce I. Davidson, Kanata (CA)

(73) Assignee: Blue Heron Solutions, Ottawa, Ontario (CA)

( * ) Notice: Subject to any disclaimer, the term of this patent is extended or adjusted under 35 U.S.C. 154(b) by 682 days.

(21) Appl. No.: 12/307,465

(22) PCT Filed: Jul. 5, 2007

(86) PCT No.: PCT/CA2007/001189

§ 371 (c)(1),
(2), (4) Date: Jan. 5, 2009

(87) PCT Pub. No.: WO2008/003171

PCT Pub. Date: Jan. 10, 2008

(65) Prior Publication Data

US 2009/0314774 A1 Dec. 24, 2009

(30) Foreign Application Priority Data

Jul. 6, 2006 (CA) ..... 2551934

(51) Int. Cl.
*B65D 21/02* (2006.01)

(52) U.S. Cl. ..... 220/23.83; 224/197; 220/479; 206/806

(58) Field of Classification Search ..... 206/806; 220/23.83; 248/230.1, 311.2, 482, 478, 479, 248/476, 751; 224/197
See application file for complete search history.

(56) References Cited

U.S. PATENT DOCUMENTS 1,130,882 A * 3/1915 Bohlman ..... 248/213.2
1,318,850 A * 10/1919 De Yong ..... 362/396
3,550,824 A * 12/1970 Bohanski ..... 224/197
3,790,023 A * 2/1974 Filipowicz ..... 221/304

(Continued)

FOREIGN PATENT DOCUMENTS

JP 2000-53205 2/2000

OTHER PUBLICATIONS

A brochure for the Envoy[tm] Cup Bank obtained by Daniel Spence in Mar. 2009 from a colleague.

(Continued)

*Primary Examiner* — J. Gregory Pickett
*Assistant Examiner* — Raven Collins
(74) *Attorney, Agent, or Firm* — Faegre Baker Daniels LLP

(57) ABSTRACT

An apparatus for receiving and storing a plurality of nestable articles comprising an elongate tubular receptacle for receiving and storing the plurality of articles as a nested stack of articles. The receptacle has an open article-receiving end and a partially open other end for retaining the nested stack of articles in the receptacle. Attachment means are provided on an exterior surface of the receptacle for pivotally suspending the receptacle from a waste container for rotation relative to the waste container about a pivot point. In use, the receptacle is held on the waste container with the open article-receiving end positioned above the partially open other end. Upon rotation of the receptacle about the pivot point so that the article-receiving end is positioned below the partially open other end, the nested stack of articles are removable under gravity from the receptacle through the open article-receiving end.

15 Claims, 2 Drawing Sheets

U.S. PATENT DOCUMENTS

| | | | | |
|---|---|---|---|---|
| 5,115,914 | A | 5/1992 | Dario | |
| 5,263,602 | A | 11/1993 | Lathouris | |
| 5,370,228 | A | 12/1994 | Manke | |
| 5,551,565 | A | 9/1996 | Kendrick | |
| 6,227,400 | B1 * | 5/2001 | Paladino | 220/478 |
| 7,404,534 | B1 * | 7/2008 | Hajianpour | 248/230.1 |

OTHER PUBLICATIONS

Printouts obtained from Glasdon web-site located at the URL http://www.glasdon.com/GlasdonUK/HierarchyProducts/envoy[tm]__cup__bank__954__True.aspx (Accessed Apr. 1, 2009).

Japanese Patent Document together with English language abstract.

* cited by examiner

ARTICLE STACKING APPARATUS

FIELD OF THE INVENTION

The present invention relates to apparatus for stacking nestable articles such as beverage cups.

BACKGROUND OF THE INVENTION

Disposable containers, such as beverage cups and sandwich containers, are widely used in the food and beverage industry due to their convenience and low cost. This type of container is often used in restaurants as well as at large public functions, such as outdoor music festivals and the like. Disposable containers create a significant volume of waste due to the shape of the containers even though the amount of material in the volume of waste is relatively small. There is therefore a need to reduce the volume of waste collected at such functions to be brought to landfills and other waste disposal sites.

One way of reducing the volume of waste generated by this type of function would be to manually stack and arrange collected waste. This is quite obviously a very tedious and time-consuming task. Garbage crushers may also be used to reduce the volume of waste but the necessary facilities are expensive and not widely available.

U.S. Pat. No. 5,115,914 (Dario) discloses a container for used plastic glasses. The container comprises a plurality of guides to stack the used glasses in a nesting arrangement. The container is lined with a garbage bag. When the guides are full of used glasses, the guides can be removed leaving a plurality of stacks of glasses in the garbage bag. While this container does reduce the volume of waste generated, it is quite cumbersome to empty the glasses from the container as they will have formed a large rigid stack within the container.

Similarly, U.S. Pat. No. 5,263,602 (Lathouris) discloses a container system for recycling beverage cans and the like comprising a plurality of lined containers. The lined containers are dimensioned to contain a plurality of adjacent columns of stacked cans. The inner liner can be removed when full. Emptying this container system is also quite cumbersome as each liner will support a plurality of adjacent columns of stacked cans. The liners themselves are not of a standard shape and may be expensive to manufacture.

In addition to efforts to reduce volume of waste, there have also been developments in the use of environmentally friendly materials. For example, it is now possible to create disposable articles (e.g. containers for food and beverages) that are biodegradable and/or compostable. However, as not all waste collected at a particular site will be biodegradable and/or compostable, the biodegradable and/or compostable waste must be separated from the rest of the collected waste. This is also a tedious and time-consuming (therefore expensive) task.

SUMMARY OF THE INVENTION

In accordance with an aspect of the invention there is provided an apparatus for receiving and storing a plurality of nestable articles. The apparatus comprises an elongate tubular receptacle for receiving and storing the plurality of articles as a nested stack of articles. The receptacle has an open article-receiving end and a partially open other end for retaining the nested stack of articles in the receptacle. The apparatus further comprises attachment means on an exterior surface of the receptacle for pivotally suspending the receptacle from a waste container for rotation relative to the waste container about a pivot point. In use, the receptacle is held on the waste container with the open article-receiving end positioned above the partially open other end. Upon rotation of the receptacle about the pivot point so that the article-receiving end is positioned below the partially open other end, the nested stack of articles is removable under gravity from the receptacle through the open article-receiving end.

In accordance with another aspect of the invention, the apparatus further comprises a waste container.

With the presently described apparatus, nestable articles such as beverage containers and the like may be easily stacked to reduce volume of waste. The stacked articles may be easily removed from the receptacle for transport to a disposal site. Further, the stacked articles are separated from the remainder of the waste in the associated waste container so that they may be diverted to a different disposal site, if desired.

BRIEF DESCRIPTION OF THE DRAWINGS

These and other advantages of the invention will become apparent upon reading the following detailed description and upon referring to the drawings in which.

Figure 2:
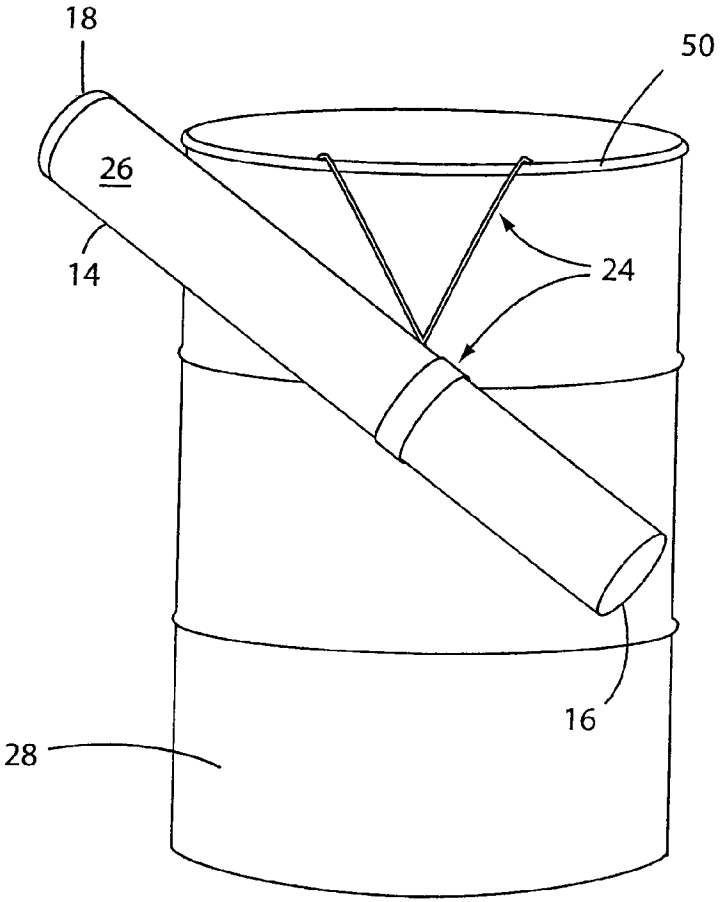
FIG. 2 is a front perspective view of the apparatus of FIG. 1, in use in a second position.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given identical reference numerals where appropriate. All dimensions described herein are intended solely to illustrate an embodiment. These dimensions are not intended to limit the scope of the invention that may depart from these dimensions.

Figure 1:
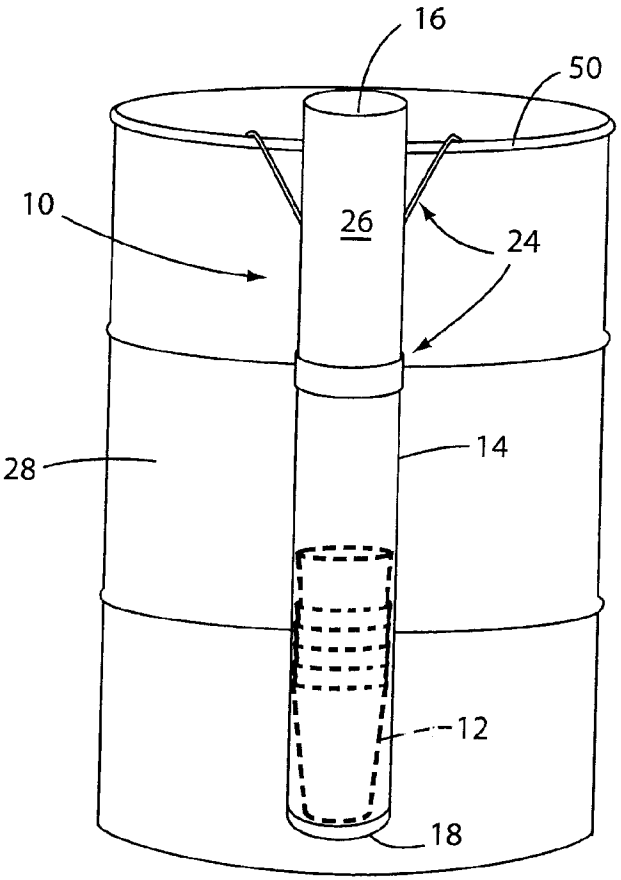
FIG. 1 is a front perspective view of apparatus in accordance with an embodiment of the invention, in use in a first position, showing a nested stack of containers in phantom.

FIG. 1 illustrates apparatus 10 for receiving and storing a plurality of nestable articles 12. Apparatus 10 comprises an elongate tubular receptacle 14 for receiving and storing the plurality of articles 12 as a nested stack of articles 12. The receptacle 14 has an open article-receiving end 16 and a partially open other end 18 for retaining the nested stack of articles 12 in the receptacle 14.

Attachment means 24 are provided on an exterior surface 26 of the receptacle 14 for pivotally suspending the receptacle 14 from a waste container 28, such as a garbage can. It should be understood that the receptacle 14 may be suspended from any suitable container. The receptacle 14 is thus suspended for rotation about a pivot point 30 (FIG. 3) relative to the waste container 28 so that, in use, the receptacle 14 is held on the waste container 28 with the open article-receiving end 16 above the partially open other end 18.

Upon rotation of the receptacle 14 about the pivot point 30 so that the article-receiving end 16 is below the partially open other end 18, as shown in FIG. 2, the nested stack of articles 12 is removable under gravity from the receptacle 14 through the open article-receiving end 16. The nested stack of articles 12 may be emptied into a garbage bag or a garbage container (not illustrated) for transport to a waste disposal site. Where the articles 12 are biodegradable and/or compostable, they are thus separated and ready for transport to a different disposal site, unlike the remainder of the collected waste (e.g. the waste in waste container 28).

Attachment means 24 may be positioned on receptacle 14 so that a center of gravity of the receptacle 14 is below the pivot point. (The center of gravity of the receptacle 14 will of course be dynamic as the distribution of weight in the receptacle 14 will change as the articles 12 are dropped into the receptacle 14.) The receptacle 14 is preferably held on the waste container 28 in a substantially vertical orientation. It should of course be understood that the receptacle 14 may alternatively be held at an angle from vertical.

Figure 3:
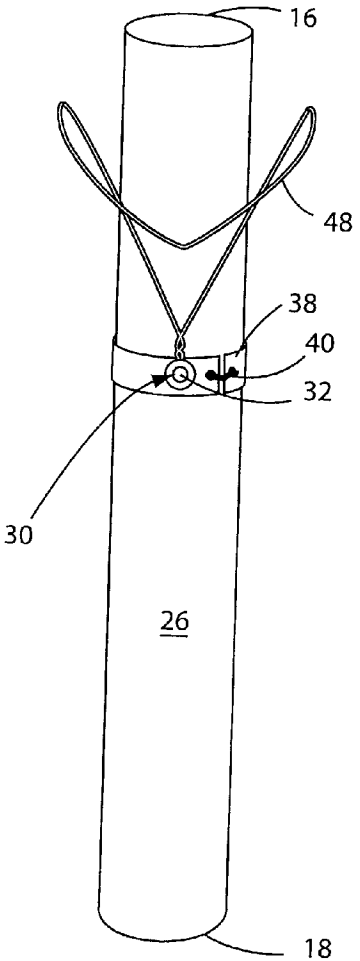
FIG. 3 is a rear perspective view of the receptacle and attachment means of FIG. 1.

The attachment means 24 is configured so as to be releasably attachable to the receptacle 14. FIG. 3 illustrates an embodiment of the invention in which the attachment means 24 comprises an expandable collar 38. The collar 38 may be provided with securing means 40 for contracting it and releasably securing it to the receptacle 14. The securing means 40 may be a cable tie or any other suitable securing means.

Figure 5:
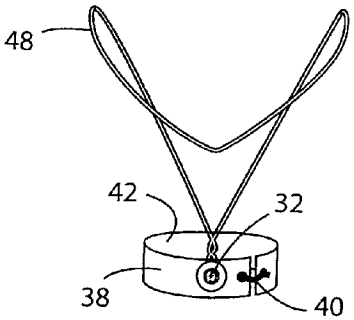
FIG. 5 is a rear perspective view of the attachment means of FIG. 3, detached from the receptacle.
Figure 4:
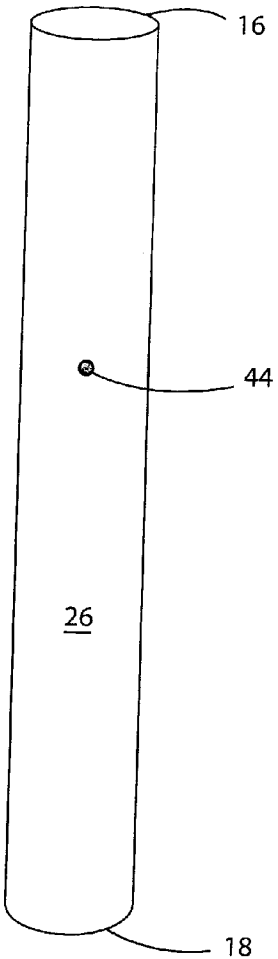
FIG. 4 is a rear perspective view of the receptacle of FIG. 3 with the attachment means removed.

Referring also to FIGS. 4 and 5, a protrusion, such as the head of a bolt 32, may be provided on an inside surface 42 of the collar 38. The protrusion may be adapted to fit into a corresponding hole 44 in the exterior surface 26 of the receptacle 14 so as to secure the collar 38 in position. Bolt 32 fits snugly into a corresponding hole in the collar 38 and also serves as the pivot for the receptacle 14 as will be described below.

The attachment means 24 may further comprise hook means 48 pivotally connected to and extending upwardly from the collar 38 for securing the receptacle 14 to a rim 50 of the waste container 28. The hook means 48 may be a suitably shaped piece of wire, such as the wire of a clothes-hangar. It is envisioned that any suitable hook means 48 may be used. Preferably, hook means 48 lies flat against the waste container 28 so that the hook means 48 can be covered by folding over a top portion of a garbage bag lining the waste container 28. Hook means 48 may be pivotally connected to the collar 38 by looping around bolt 32.

Figure 6:
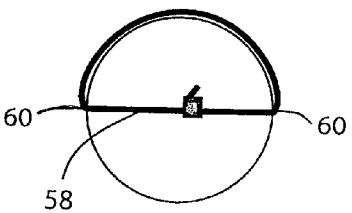
FIG. 6 is a bottom view of the receptacle of FIG. 4.

End 18 is configured so as to retain the nested stack of articles 12 in the receptacle 14 while remaining partially open to prevent the collection of for example rainwater and the like. Referring to FIG. 6, this may be accomplished by threading a cable tie 58 through opposing holes 60 in the side wall 46 of the receptacle 14 proximal to the partially open other end 18. It should be understood that any suitable means for retaining the nested stack of articles 12 in the receptacle 14 while leaving it open to prevent the collection of rainwater and the like may be used.

Receptacle 14 and collar 38 may be manufactured from any suitable durable plastic or other material, such as Perspex™ or the like. For example, the receptacle 14 may be manufactured by cutting suitable lengths of a standard electrical conduit.

The receptacle 14 may be circular in cross-section as illustrated. This shape would be particularly suitable for receiving and storing beverage containers, such as beer cups. Of course, it should be understood that any suitable shape of receptacle 14 may be used. Also, it is important to note that the shape of the receptacle 14 does not necessarily have to match the shape of the articles to be received and stored, although this would be preferable where the articles have a preferred stacking orientation.

It should be understood that embodiments of the invention are not limited to stacking nestable articles. For example, aluminium cans could be stacked using apparatus 10. The volume of waste created is of course reduced to a greater degree where the articles are nestable.

It is apparent that there has been provided in accordance with the invention apparatus that fully satisfy the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What is claimed is:

1. An apparatus for receiving and storing a plurality of nestable articles comprising:

a waste container;

an elongate tubular receptacle for receiving and storing the plurality of articles as a nested stack of articles, the receptacle having an open article-receiving end and a partially open other end for retaining the nested stack of articles in the receptacle;

attachment means on an exterior surface of the receptacle for pivotally suspending the receptacle from the waste container for rotation of the receptacle relative to the waste container about a pivot point so that, in use, the receptacle is held on the waste container with the open article-receiving end positioned above the partially open other end, wherein upon rotation of the receptacle about the pivot point so that the article-receiving end is positioned below the partially open other end, the nested stack of articles are removable under gravity from the receptacle through the open article-receiving end.

2. An apparatus for receiving and storing a plurality of nestable articles comprising:

an elongate tubular receptacle for receiving and storing the plurality of articles as a nested stack of articles, the receptacle having an open article-receiving end and a partially open other end for retaining the nested stack of articles in the receptacle;

attachment means on an exterior surface of the receptacle for pivotally suspending the receptacle from a waste container for rotation of the receptacle relative to the waste container about a pivot point so that, in use, the receptacle is held on the waste container with the open article-receiving end positioned above the partially open other end, wherein upon rotation of the receptacle about the pivot point so that the article-receiving end is positioned below the partially open other end, the nested stack of articles is removable under gravity from the receptacle through the open article-receiving end;

wherein the attachment means comprises a collar; and wherein a protrusion is provided on an inside surface of the collar, the protrusion being adapted to fit into a corresponding hole in a side wall of the receptacle so as to secure the collar in position.

3. The apparatus according to claim 2 wherein the collar is configured so as to be releasably attachable to the receptacle.

4. The apparatus according to claim 2, wherein the attachment means is positioned so that a center of gravity of the receptacle is below the pivot point.

5. The apparatus according to claim 2, wherein the receptacle is held on the waste container in a substantially vertical orientation.

6. The apparatus according to claim 2, wherein the attachment means further comprises hook means pivotally connected to and extending upwardly from the collar for securing the receptacle to a rim of the waste container.

7. The apparatus according to claim 2, wherein the receptacle has a circular cross-section.

8. An apparatus for receiving and storing a plurality of nestable articles comprising:

an elongate tubular receptacle for receiving and storing the plurality of articles as a nested stack of articles, the receptacle having an open article-receiving end and a partially open other end for retaining the nested stack of articles in the receptacle;

attachment means on an exterior surface of the receptacle for pivotally suspending the receptacle from a container for rotation of the receptacle relative to the container about a pivot point so that, in use, the receptacle is held on the container with the open article-receiving end positioned above the partially open other end, wherein upon rotation of the receptacle about the pivot point so that the article-receiving end is positioned below the partially open other end, the nested stack of articles is removable under gravity from the receptacle through the open article-receiving end;

wherein the attachment means comprises a collar attachable to the receptacle and suspension means for pivotally suspending the collar and receptacle to the container.

9. The apparatus according to claim 8 wherein the suspension means comprise hook means pivotally connected to and extending upwardly from the collar for securing the receptacle to a rim of the container.

10. The apparatus according to claim 8, wherein the collar has securing means for releasably securing the collar to the receptacle.

11. The apparatus according to claim 8, wherein a protrusion is provided on an inside surface of the collar, the protrusion being adapted to fit into a corresponding hole in a side wall of the receptacle so as to secure the collar in position.

12. The apparatus according to claim 8, wherein the collar is configured so as to be releasably attachable to the receptacle.

13. The apparatus according to claim 8, wherein the attachment means is positioned so that a center of gravity of the receptacle is below the pivot point.

14. The apparatus according to claim 8, wherein the receptacle is held on the container in a substantially vertical orientation.

15. The apparatus according to claim 8, wherein the receptacle has a circular cross-section.

* * * * *